US005088568A

United States Patent [19]

Simuni

[11] Patent Number: 5,088,568

[45] Date of Patent: Feb. 18, 1992

[54] HYDRO-MECHANICAL DEVICE FOR UNDERGROUND DRILLING

[76] Inventor: Leonid Simuni, Apt. 6A, Far Rockaway, N.Y. 11691

[21] Appl. No.: 539,884

[22] Filed: Jun. 18, 1990

[51] Int. Cl.[5] ..... E21B 7/14

[52] U.S. Cl. ..... 175/14; 175/19; 175/92; 175/296; 175/381

[58] Field of Search ..... 175/14, 17, 15, 19, 175/92, 93, 293, 296, 381

[56] References Cited

U.S. PATENT DOCUMENTS

| | | | |
|---|---|---|---|
| 2,675,993 | 4/1954 | Smith et al. | 175/13 |
| 2,694,550 | 11/1954 | Aitchison et al. | 175/14 |
| 3,212,592 | 10/1965 | Rolseth et al. | 175/14 |
| 4,076,082 | 2/1978 | Baum et al. | 175/14 |
| 4,519,453 | 5/1985 | Riddiford | 175/14 |

FOREIGN PATENT DOCUMENTS

| | | | |
|---|---|---|---|
| 445746 | 6/1975 | U.S.S.R. | 175/14 |
| 473012 | 9/1975 | U.S.S.R. | 175/14 |
| 519539 | 7/1976 | U.S.S.R. | 175/14 |
| 562650 | 8/1977 | U.S.S.R. | 175/14 |
| 1073424 | 2/1984 | U.S.S.R. | 175/14 |
| 526191 | 8/1986 | U.S.S.R. | 175/14 |

*Primary Examiner*—Hoang C. Dang

[57] ABSTRACT

A hydro-mechanical device for underground drilling for use with a drilling rig comprises a container having a combustion chamber, an ignition system, inlets for introducing a fuel, an oxidizer, a liquid into the combustion chamber, a nozzle for discharging combustion products, a piston slidably mounted in the container and a reamer connected to the piston. The ignition system provides electro-discharges in the fuel, oxidizer, liquid mixture. Each electro-discharge has an explosive nature and produces combustion products having a high pressure. Combustion products are ejected through the circular nozzle surrounding the container to provide a thermal drilling action. The movable piston is pushed downwardly by the products of electro-discharge and causes the reamer to penetrate rocks or a frozen ground to provide a percussion drilling action. By the use of combined effect of thermo-percussion drilling, holes of significant depth can be drilled and rocks or frozen ground of high hardness can be pierced. The present invention is adapted for underground and undersea drilling.

4 Claims, 2 Drawing Sheets

HYDRO-MECHANICAL DEVICE FOR UNDERGROUND DRILLING

BACKGROUND OF THE INVENTION

1. Field of the Invention

This invention relates to hydro-mechanical devices for underground or undersea drilling and more particularly to devices for thermo-percussion drilling.

2. Prior Art

Hydro-mechanical devices for underground drilling are produced and utilized in a great variety of constructions but the efficiency of existing devices for drilling is not enough sufficient.

This invention has two primary objects. First is to provide the underground and undersea drilling using the same device. Second is to increase the speed of the drilling.

It is therefore believed to be evident that any attempts to increase the efficiency and the speed of existing hydro-mechanical devices for undersea and underground drilling are very desirable.

SUMMARY OF THE INVENTION

Accordingly, the objects of the present invention are to improve the efficiency and to increase the speed of devices for underground and undersea drilling. In keeping with these objects and with others which will become apparent hereinafter, a hydro-mechanical device for underground and undersea drilling comprises:

a container having a combustion chamber;

inlet means for introducing a fuel, an oxidizer and a liquid respectively into the combustion chamber;

outlet means for discharging combustion products from the combustion chamber;

drilling means outside of the container;

means for providing remote information regarding the formation being drilled;

a generator of instantaneous electro-impulses having means for accumulation of electro-energy;

electrodes to produce electro-discharge in the combustion chamber.

system for supplying fuel and oxidizer;

a system for supplying liquid which may be water for inland drilling or sea water for off-shore drilling.

The present invention may be used for underground drilling, including frozen ground and for undersea drilling.

The novel features of the present invention are set forth in particular in the appended claims. The invention itself, however, both as to its construction and its manner of operation will be best understood from the following description of the preferred embodiment which is accompanied by the following drawings illustrating the invention.

DESCRIPTION OF A PREFERRED EMBODIMENT

Figure 1:
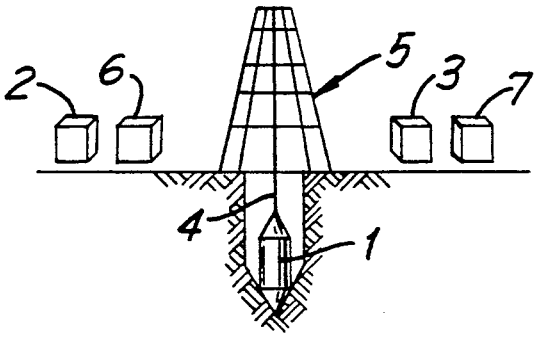
FIG. 1 is a scheme of the plant for drilling.
Figure 2:
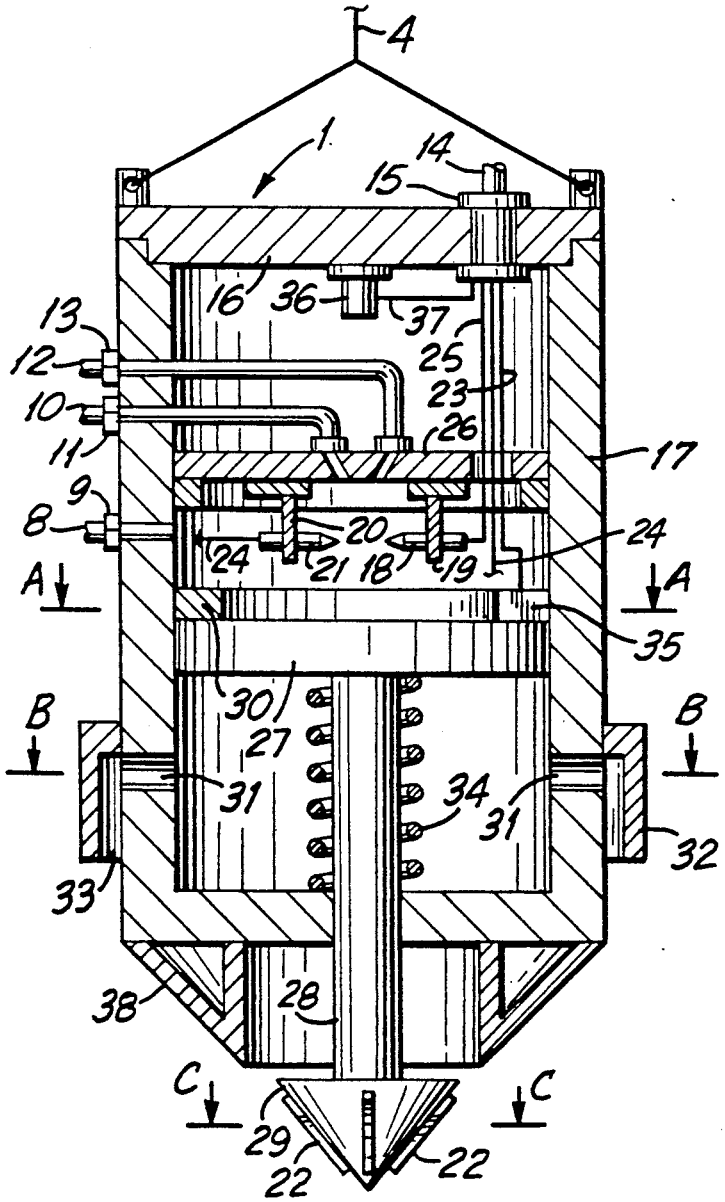
FIG. 2 is a cross section of the hydro-mechanical device for drilling.
Figure 3:
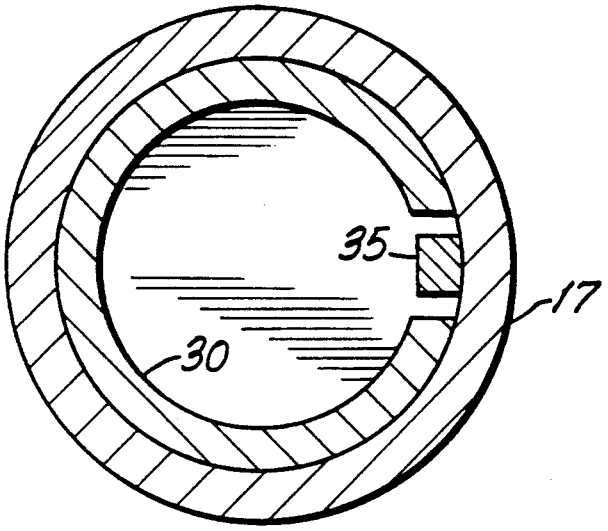
FIG. 3 is a section taken along the line A—A of FIG. 2.
Figure 4:
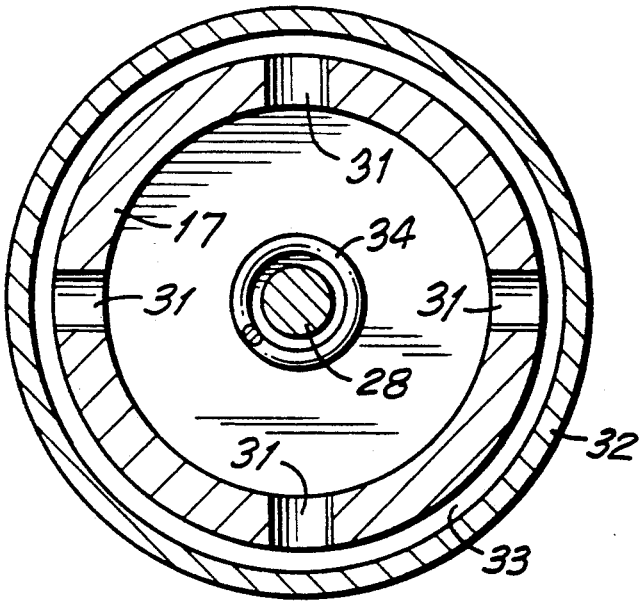
FIG. 4 is a section taken along the line B—B of FIG. 2.
Figure 5:
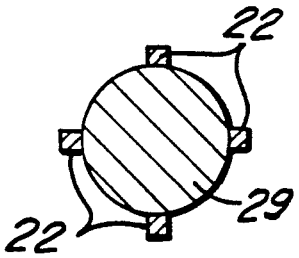
FIG. 5 is a section taken along the line C—C of FIG. 2.

The hydro-mechanical device for underground drilling is identified as a whole with reference numeral 1. The device 1 has a container 17, a cover 16, a piston 27, a rod 28, a generator of ultrasonic vibration 36 having means for providing remote information regarding the formation being drilled; a spring 34 and a reamer 29.

The reamer 29 is means for percussion drilling. The reamer 29 includes plates 22 which are made from a hard alloy. A fuel, an oxidizer, and a water supply 2,6,7 are fed into the combustion chamber of device 1 by pipes. The combustion chamber is formed in the container 17 between the partition 26 and the piston 27. The inlets 9,11,13 and the pipes 8,10,12 are employed for introducing respectively the liquid, fuel and oxidizer into the combustion chamber. The inlet means 9,11,13 are fixedly mounted to the container 17. Tanks for the fuel and oxidizer are not shown. The container 17 is connected with a drilling rig 5 by a descent-ascent cable 4. The drilling rig 5 comprises an electro-device 3 for generating instantaneous electro-impulses between electrodes 18 and 21, which are secured separately to the partition 26 by supporting bars 19 and 20. All cables 14 enter the container 17 through an insulating box 15. All electro-equipment and cables inside of the container 17 must be protected from the influence of high temperature and pressure. The cable 37 connects the generator of ultrasonic vibration 36 with the cockpit. The generator 36 includes means for providing remote information regarding the formation being drilled, including a detector of formations and an amplifier. The cables 24,25 are employed to connect the electrodes 18,21 with the generator of instantaneous electro-impulses 3 which has means for accumulation of electroenergy to produce an electro-discharge between the electrodes 18,21. One electrode is anode, the second is cathode. The means for accumulation of electroenergy may be arranged inside of the container 17 for connection with the electrodes 18,21. The cable 23 is employed to connect the appliance 35 with the generator of instantaneous electro-impulses 3. The pipe 8 is arranged so to form the mixture of fuel, oxidizer, and water. Instead of water an electrolyte may be employed for the underground drilling. Sea water may be used as the liquid in the case of undersea drilling. The oxidizer may be oxigen or compressed air. The ignition energy must be enough to create a discharge in a fuel, oxidizer, liquid mixture between the electrodes 18 and 21, to create suitable combustion performances and to create the high pressure in the combustion chamber.

It is known that an electro-discharge in water creates high pressure impulses. The capacitor, for example, accumulates the electro-energy. Electrons from the cathode penetrate the fuel/oxidizer/water mixture, forming the start of the streamer. The streamer splits the fuel/oxidizer/water mixture between electrodes 18,21 in time of approach to the anode. Streamer also causes ignition of this mixture and forms a cavity between electrodes 18 and 21. The cavity contains gases, steam and plasma. Each impulse takes place in a very short time, has explosive nature and creates the high pressure in the container 17. After each impulse the electric streamer is broken. The generator of impulses 3 again accumulates electro-energy and the process is repeated. So, it is a pulsating mode of operation. The reamer 29 is joined to the piston 27 by the rod 28. Plates 22 of reamer 29 are made for example from hard alloy steel for penetrating rocks and frozen ground. Each electro-discharge produces the mixture of hot gaseous products in the combustion chamber. The piston 27 is pushed downwardly by the products of the electro-discharge causing the percussion drilling by reamer 29 penetrating rocks and frozen ground. The piston 27 is slidably mounted in the container 17 for movement between an upper position and a lower position which allows the discharge of combustion products from the combustion chamber through the outlet means. Outlet means of device 1 are openings 31 and nozzle 33. The nozzle 33 is formed in part by a circular guide 32 surrouding the container 17. The openings 31 are arranged so as to provide ejecting combustion products when the piston 27 is in the lower position. The ejection of combustion products through the nozzle 33 provides the thermal drilling of rocks and frozen ground. The container 17 is provided with conical structure 38 in the lower portion of the container. The reamer 29 and the structure 38 have conical surfaces which are adapted to remove debris of rocks and frozen ground previously weakened by the products of electro-discharges.

After each electro-discharge the spring 34 returnes piston 27 to its upper position. Stop 30 is for limiting the upper position of the piston. Appliance 35 is to switch on the electric circuit of the generator 3 of instantaneous electro-impulses for the next electro-discharge. The electric circuit of generator 3 is broken when piston 27 moves down at the time of electro-discharge.

The combined effect of thermo-percussion drilling provides a downwardly motion of the device 1 under acceleration of gravity. The speed of piercing rocks depends on the pressure and temperature of combustion products, that depends on the consumption of fuel and power of the electro-discharge. The lifting mechanism of rig 5 provides the lift of device 1 by the cable 4. The cockpit or the control room having control panels for controlling the fuel, oxidizer, liquid, ignition systems and mechanism to lift the hydro-mechanical device for underground drilling is not shown.

I claim:

1. A hydro-mechanical device for underground drilling for use with a drilling rig comprising:

a container defining a combustion chamber therein;

inlet means associated with said container for introducing a fuel, an oxidizer and a liquid respectively into said combustion chamber;

outlet means associated with said container for discharging combustion products from said combustion chamber;

a piston slidably mounted in said container for movement between an upper position above said outlet means and a lower position below said outlet means and allowing the discharge of said combustion products from said combustion chamber through said outlet means; drilling means outside of said container and connected to said piston for movement therewith;

means operatively connected to said container for providing remote information regarding the formation being drilled;

a generator of instantaneous electro-impulses, said generator having means for accumulation of electro-energy; and electrodes separately secured to said container and connected to said generator of instantaneous electro-impulses to produce electro-discharge between said electrodes.

2. A hydro-mechanical device for underground drilling as defined in claim 1, wherein said outlet means including a nozzle formed in part by a circular guide surrounding said container.

3. A hydro-mechanical device for underground drilling as defined in claim 1, wherein said piston is pushed downwardly by means of products of electro-discharge in said combustion chamber, thereby causing said drilling means to penetrate rocks.

4. A hydro-mechanical device for underground drilling as defined in claim 1, wherein said drilling means and the lower end of said container have a conical shape to remove debris during drilling.

* * * * *